US005219274A

United States Patent [19]

Pawlowski et al.

[11] Patent Number: 5,219,274

[45] Date of Patent: Jun. 15, 1993

[54] PUMP WITH INTERNAL PRESSURE RELIEF

[75] Inventors: Harold D. Pawlowski; Lowell V. Grover, both of Fort Wayne, Ind.

[73] Assignee: Tuthill Corporation, Fort Wayne, Ind.

[21] Appl. No.: 927,004

[22] Filed: Aug. 10, 1992

[51] Int. Cl.[5] ..... F04B 49/00; F04B 17/00

[52] U.S. Cl. ..... 417/213; 417/214; 417/413 R

[58] Field of Search ..... 417/213, 413, 214 R, 417/328

[56] References Cited

U.S. PATENT DOCUMENTS

| | | | |
|---|---|---|---|
| 2,653,544 | 9/1953 | Katcher | 417/470 |
| 3,801,232 | 4/1974 | Kilayko | 417/413 |
| 4,856,966 | 8/1989 | Ozawa | 417/413 |
| 4,931,000 | 6/1990 | Fleming | 417/413 |

FOREIGN PATENT DOCUMENTS

| | | | |
|---|---|---|---|
| 25593 | 2/1983 | Japan | 417/214 |
| 113588 | 7/1983 | Japan | 417/214 |
| 1109532 | 8/1984 | U.S.S.R. | 417/214 |

*Primary Examiner*—Richard A. Bertsch
*Assistant Examiner*—Roland McAndrews
*Attorney, Agent, or Firm*—Roger M. Rickert

[57] ABSTRACT

A fluid pump having a rotary power source, a rotary to reciprocating motion converter in the form of a cam and cam follower, a rotary speed reducing gear train coupling the rotary power source to the rotary to reciprocating motion converter, and no pressure relief bypass is disclosed. The pressure relief function of limiting the fluid pressure within the pumping chambers to predetermined maximum pressures is provided by a pair of springs coupling a pair of opposed diaphragms of a pair of pumping chambers. The springs function as a spring-loaded lost motion coupling which absorbs energy while limiting the pressure in a pumping chamber and releases that stored energy to help power the pump while expelling fluid from the other chamber. The diaphragms are fixed relative to their respective pumping chambers about their outer peripheries and centrally coupled to their respective springs. The diaphragms are normally driven to move in unison, but cease to move in unison when one of the springs yields. The pump is especially adapted to pumping relatively viscous fluids. Each chamber has one-way inlet check valves and one-way outlet check valves. There is a common pump outlet for merging the viscous liquids emanating from the chamber outlet check valves and a common pump inlet for supplying the viscous fluid to the chamber inlet valves.

18 Claims, 2 Drawing Sheets

PUMP WITH INTERNAL PRESSURE RELIEF

SUMMARY OF THE INVENTION

The present invention relates generally to pumps and more particularly to pumps which handle agricultural chemicals or other variable viscosity liquids. In particular, the present invention relates to a pump with a pressure relief feature, but no pressure relief bypass, and to such a pump having opposed "push-pull" diaphragms with a cam follower coupling the pump to a power source.

It is not uncommon to add a clay to certain farm chemicals in order to keep the constituents in suspension. This results in a variable viscosity fluid, something similar to a viscosity range of SAE 10 to SAE 90 weight oil. The bypass valve of a pump with a standard relief valve and bypass conduit induces an agitation and a shear in many of these viscous fluids resulting in overheating and an uncontrolled thickening or thinning of the fluid. Such undesirable shear is also created by the violent action of a centrifugal impeller, rotary gear, rotary vane, and the speed of throwing the material in the cavities of the pump housing. Moreover, the use of reed valves, either in the bypass or elsewhere in the pump, in conjunction with such materials is unacceptable because the high velocity of the material past the relatively narrow reed slit frequently causes the dispersions to break down. Also, the particles in such agricultural chemicals are often sufficiently large to block a reed valve open. While power take off driven diaphragm pumps, rotary gear pumps, rotary vane pumps, and hand actuated pumps have all been used to pump such agricultural mixtures, it is typically not practical to simply eliminate the pressure relief bypass from agricultural chemical pump because of the possibility of excess chamber pressures damaging the equipment. As a result, more complicated, cumbersome and expensive compressed air driven diaphragm pumps are typically used in agricultural chemical environments.

In quite dissimilar environments, typically refined petroleum fuel transfer pumps, springs for limiting pumping chamber pressure are known. For example, the Katcher U.S. Pat. No. 2,653,544 shows leaf springs coupling a drive mechanism to a pair of opposed, but dissimilar diaphragms in an otherwise somewhat conventional internal combustion engine fuel pump. Such pumps necessarily operate over a wide range of engine speeds and are effective pumps at the high end of the speed range only. In their environment, they need only be efficient at the high speeds, but in other environments, this lack of low speed efficiency limits their use. The Flint U.S. Pat. No. 2,022,660 similarly has a coil spring which yields to limit head pressure in an automotive fuel pump and U.S. Pat. No. 2,631,538 to Johnson shows a cam driven diaphragm pump having a compression spring to prevent excess pressure within the pumping chamber. Each of these prior devices employ a single ended pump using springs solely for the purpose of controlling head pressure.

In conventional automotive fuel pumps, if the outlet is blocked (no fuel demand), the diaphragm is held by the pressure in the pumping chamber and simply is not returned to its original position by the diaphragm spring, hence, the effective pump stroke is shortened and the pump output diminished. Another way in which diaphragm stroke is shortened is by a mechanical block which keeps a spring from returning the diaphragm completely against the smaller diameter part of a cam drive. Thus the cam engages and moves the diaphragm during a fraction only of its revolution. Neither scheme is energy efficient.

None of the references realize that an opposed "push-pull" diaphragm pump with a pair of springs alternately yielding to limit pumping chamber pressure will store energy which may be retrieved for the next half cycle of pump operation.

Among the several objects of the present invention may be noted the provision of a pressure relieved pump for materials of high and/or variable viscosity having no pressure relief bypass; the provision of an improved cam driven agricultural chemical pump; the provision of a diaphragm type pump according to the previous object having a spring-loaded lost motion coupling between the cam and the diaphragm; and the provision of a spring-loaded lost motion coupling in a double acting diaphragm pump which absorbs energy while limiting the pressure in a pumping chamber and releases that stored energy to help power the pump while expelling fluid from the other chamber. These as well as other objects and advantageous features of the present invention will be in part apparent and in part pointed out hereinafter.

In general, a double acting pump for moving variable viscosity liquids such as agricultural chemicals has a rotary drive mechanism for powering the pump along with a pair of opposed pumping chambers for alternately supplying the liquid under pressure from a pair of chamber inlets to a corresponding pair of chamber outlets. A shuttle block is reciprocable along a path for actuating the pumping chambers and includes a cam and follower arrangement for converting rotational motion of the drive mechanism into reciprocating motion of the shuttle block. The pumping chambers include a pair of movable members such as diaphragms which move in unison in one direction to decrease the volume of one of the pumping chambers while increasing the volume of the other of the pumping chambers, and move in the opposite direction to decrease the volume of the other of the pumping chambers while increasing the volume of the one pumping chamber. There is a resiliently yieldable arrangement coupling the shuttle block to the pair of movable members for limiting the pressure within the pumping chambers to predetermined maximum pressures. The resiliently yieldable arrangement may comprise a spring-loaded lost motion coupling and it functions to absorb energy while limiting the pressure in a chamber and releases that stored energy to help power the pump while expelling fluid from the other chamber.

Also in general and in one form of the invention, a fluid pump having a rotary power source, a rotary to reciprocating motion converter, and no pressure relief bypass, is improved by the addition of a mechanism for limiting fluid pressure without utilizing a pressure relief bypass. This mechanism comprises a pair of opposed diaphragms defining at their outwardly facing surfaces a pair of pumping chambers. The diaphragms are normally driven in unison by the rotary to reciprocating motion converter to alternately force fluid from one and then the other of the chambers. There is a resiliently yieldable coupling between the rotary to reciprocating motion converter and the diaphragms for limiting the fluid pressure within the pumping chambers to predetermined maximum pressures. Again, this coupling stores energy when it yields and subsequently releases that energy to help power the pump.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
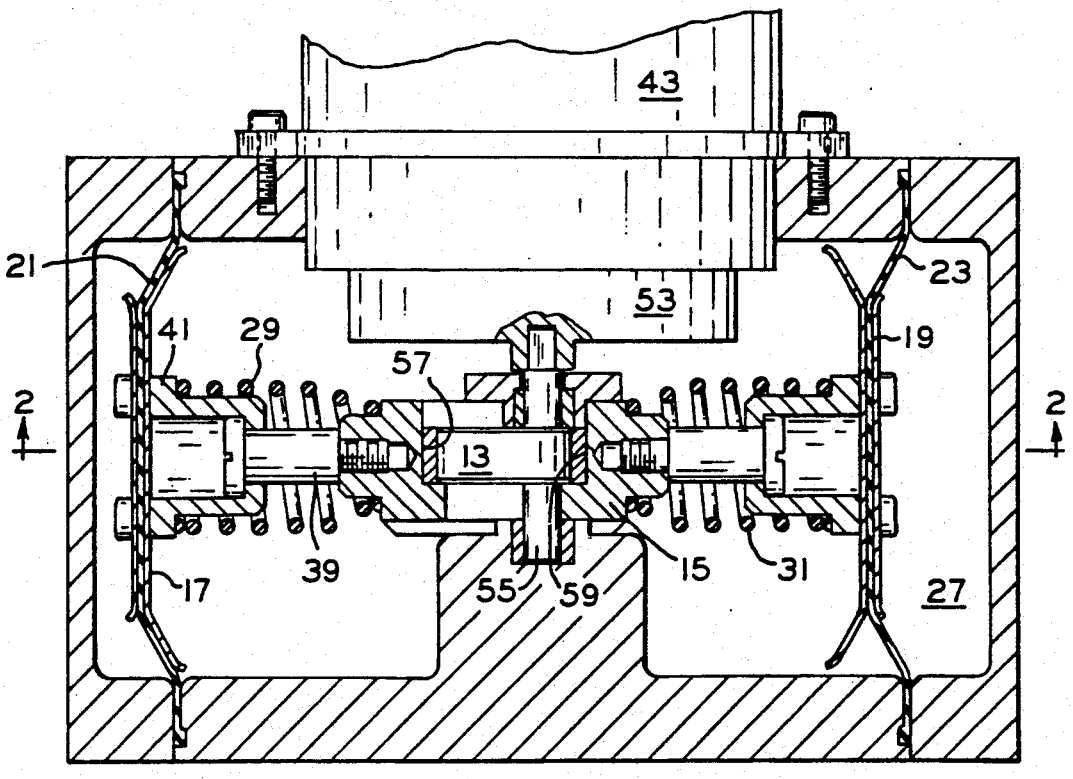
FIG. 1 is a view in cross-section of a double ended diaphragm type pump illustrating my invention in one form.
Figure 2:
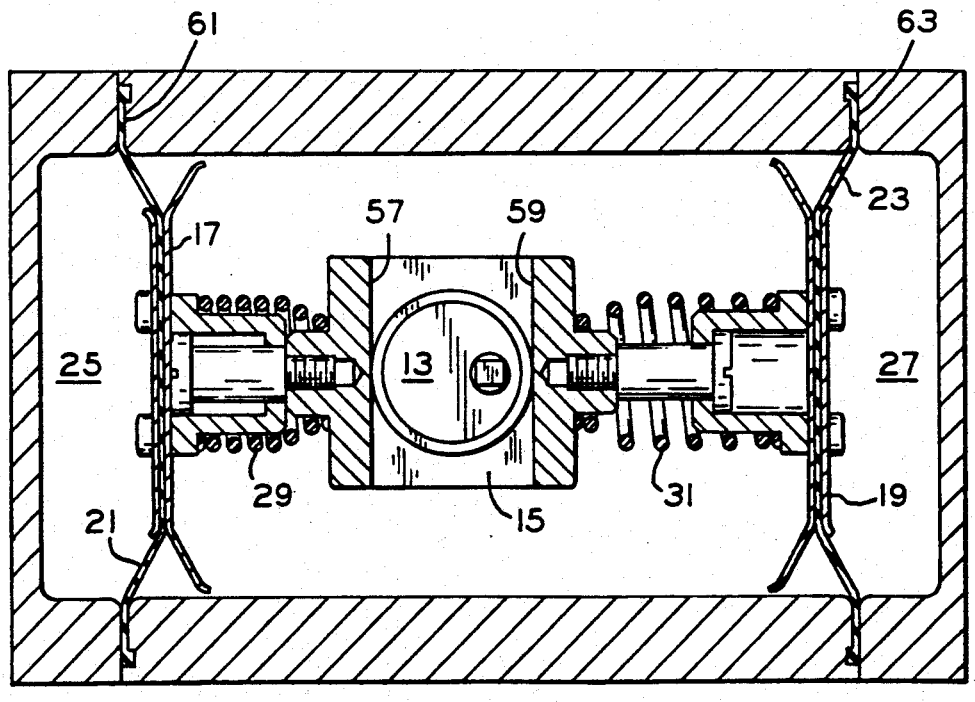
FIG. 2 is a view in cross-section along line 2—2 of FIG. 1.

A pump shown in cross-section in FIGS. 1 and 2 is intended primarily for moving agricultural chemicals which are frequently a suspension or slurry as opposed to a solution. These suspensions or slurries may include rather large particulate matter and may vary in viscosity with agitation. A shearing motion of the fluid is particularly bad in varying the material's viscosity. Pressure relief bypass loops are particularly bad in introducing such shear as are reed valves.

Figure 3:
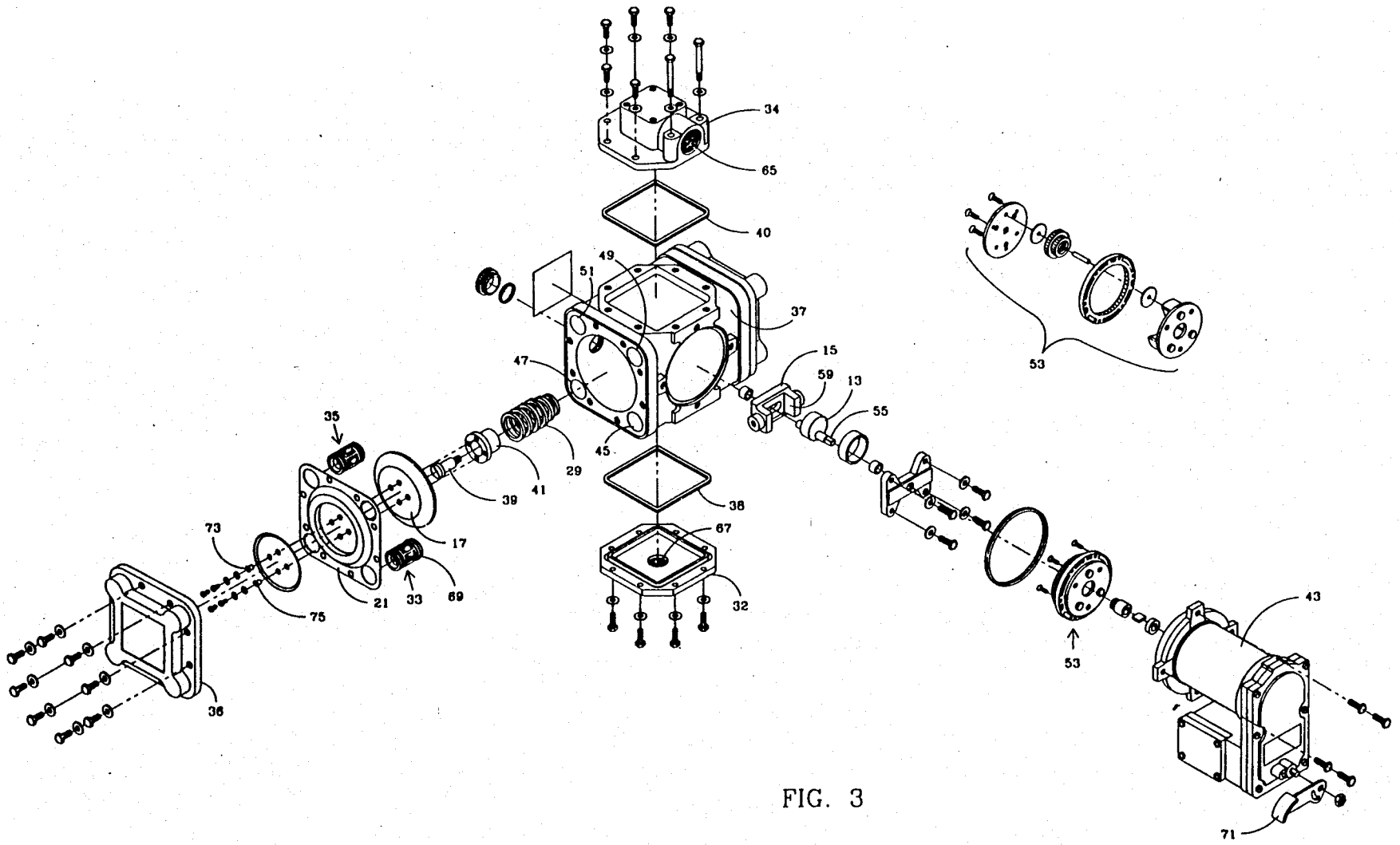
FIG. 3 is an exploded isometric view showing the pump of FIGS. 1 and 2 in greater detail.

Generally speaking, the pump is formed with a main body or housing 37 which receives a pair of opposed pumping diaphragms (only one of which is shown in FIG. 3), a driving motor assembly 43 and 53, an inlet cap 32, an outlet cap 34 and a pair of pumping chamber heads such as 36 along with typical associated gaskets such as 38 and 40. Flow within the pump is facilitated by conduits within the housing 37 as well as in the heads 36 and caps 32 and 34.

The pump is a diaphragm type. Rotary motion is converted to reciprocating motion by a cam 13 and a cam follower or shuttle block 15. A pair of diaphragms 17 and 19 having flexible web portions 21 and 23 are driven back and forth by the shuttle block. The flexible portions 21 and 23 may be made of polytetrafluoroethylene, a polyester elastomer or similar material. The working or pumping chambers are 25 and 27 and each includes at least one inlet ball check valve such as 33 and at least one outlet ball check valve such as 35. Typically, there are two inlet valves and two outlet valves. All check valves may be biased by springs such as 69 toward the closed position. At the instant shown in FIG. 1, fluid is being expelled from chamber 25, so its outlet ball valve 35 is open and the inlet ball valve 33 is seated or closed. Similarly, chamber 27 has been filled with fluid and its inlet valve (not shown) is about to close.

Rather than a direct mechanical connection between the driving rod 39 and the coupling member 41 which is fixed to the central portion of the diaphragm 17, there is a lost motion connection including the spring 29. This spring is designed to compress only at times when a bypass would otherwise be active. Should the pressure become excessive in one of the chambers 25 or 27, the remaining motion of the shuttle block's stroke is absorbed by compressing spring 29 or 31 and there is no further diaphragm motion. This situation is shown in FIG. 2 with spring 29 compressed. Thus, the spring-loaded lost motion coupling 29 or 31 absorbs energy while limiting the pressure in a chamber and, on the subsequent return stroke, releases that stored energy to help power the pump while expelling fluid from the other chamber. The diaphragms 17 and 19 cease to move in unison when the spring-loaded lost motion coupling begins to absorb energy. Energy expended compressing the spring 29 is available to help power the shuttle block 15 on the return stroke so the system is energy efficient.

The double acting pump includes an electric motor 43 or other rotary drive device for powering the pump and its associated on/off switch 71. The pair of opposed pumping chambers 25 and 27 alternately supply a liquid under pressure from a pair of chamber inlets 45 and 47 to a corresponding pair of chamber outlets 49 and 51. The chamber inlets are connected by corresponding one-way check valves such as 33 to a common inlet 67 in cap 32 by conduits in the housing 37. Similarly, the chamber outlets are coupled to a common outlet 65 in cap 34. By simply reversing the direction of the valves 33 and 35 at the time of assembly, the inlet 67 becomes an outlet and the outlet 65 becomes an inlet. The shuttle block 15 is reciprocable along a path perpendicular to the surfaces of the two diaphragms for actuating the pumping chambers. The motor 43 is coupled through a speed reduction gearbox 53 to the square drive shaft 55. The drive shaft passes through an eccentrically located square hole in cam 13 causing it to rotate about the off-center hole. The cam engages surfaces 57 and 59 thereby converting rotational motion of the drive motor into reciprocating motion of the shuttle block.

The pumping chambers 25 and 27 including a pair of members such as diaphragms 17 and 19 or pistons (not shown) movable in unison in one direction to decrease the volume of one of the pumping chambers while increasing the volume of the other of the pumping chambers, and movable in the opposite direction to decrease the volume of the other of the pumping chambers while increasing the volume of the one pumping chamber. They cease to move in unison when either coil spring 29 or 31 yields. The springs 29 and 31 couple the shuttle block 15 to the pair of movable members for limiting the pressure within the pumping chambers to predetermined maximum pressures. The pair of diaphragms 17 and 19 are fixed relative to their respective pumping chambers 25 and 27 about their outer peripheries as at 61 and 63 and centrally coupled by the driving rods such as 39 and the coupling member such as 41 to the springs 29 and 31.

Each chamber inlet 45 or 47 includes at least one one-way check valve such as 33 for allowing the liquid to enter the corresponding chamber while substantially preventing any passage of liquid from the chamber, and each chamber outlet 49 or 51 includes at least one one-way check valve such as 35 for allowing the liquid to exit the corresponding chamber while substantially preventing any passage of liquid into the chamber. There is a common pump outlet 65 for merging the liquids emanating from the chamber outlet check valves and a common pump inlet 67 for supplying the fluid to the chamber inlet valves. Such common inlets and outlets may, of course, be incorporated into the pump housing 37 as interior conduits if desired.

Significant cost reduction is achieved in the present invention by making several of the gears and other components of the pumping assembly such as the housing 37, heads 36, and caps 32 and 34 of plastic materials. This has the drawback that dissapation of heat generated within motor 43 is seriously reduced. To help compensate, an additional heat dissapation path is established from the motor 43 to the liquid being pumped through chambers 25 and 27 by way of the lubricant which partially fills the region 77 and eyelets such as 73 and 75 which pass through the diaphragms. The eyelets are made of a metal or similar material having high thermal conductivity for transferring heat from the rotary power source by way of the lubricant to the fluid within the corresponding pumping chamber.

As thus far discussed, the source of reciprocating motion which drives the diaphragms has been from an electric motor and a rotary to reciprocatory motion converter. In some implementations, for example, in the case of hand operated pumps, the rotary motion could be supplied by turning a crank and that rotary motion converted to reciprocating motion, or pump handle motion could be reciprocating with no subsequent motion conversion being required. In all cases, there is a source of reciprocating motion for driving the diaphragms.

From the foregoing, it is now apparent that a novel pumping arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A double acting pump for moving liquids comprising:

rotary drive means for powering the pump;

a pair of opposed pumping chambers for alternately supplying a liquid under pressure from a pair of chamber inlets to a corresponding pair of chamber outlets;

a shuttle block reciprocable along a path for actuating the pumping chambers;

means associated with the shuttle block for converting rotational motion of the drive means into reciprocating motion of the shuttle block;

the pumping chambers including a pair of members movable in unison in one direction to decrease the volume of one of the pumping chambers while increasing the volume of the other of the pumping chambers, and movable in the opposite direction to decrease the volume of the other of the pumping chambers while increasing the volume of the one pumping chamber; and resiliently yieldable means coupling the shuttle block to the pair of movable members for limiting the pressure within the pumping chambers to predetermined maximum pressures, the pair of members ceasing to move in unison when the resiliently yieldable means yields.

2. The double acting pump of claim 1 further comprising a rotary speed reducing gear train coupling the drive means to the means for converting.

3. The double acting pump of claim 1 wherein the pair of movable members comprise a pair of diaphragms fixed relative to their respective pumping chambers about their outer peripheries and centrally coupled to the resiliently yieldable means.

4. The double acting pump of claim 1 wherein the resiliently yieldable means comprises a pair of coil springs.

5. The double acting pump of claim 1 wherein each chamber inlet includes a one-way check valve for allowing the liquid to enter the corresponding chamber while substantially preventing any passage of liquid from the chamber.

6. The double acting pump of claim 5 wherein each chamber outlet includes a one-way check valve for allowing the liquid to exit the corresponding chamber while substantially preventing any passage of liquid into the chamber.

7. The double acting pump of claim 6 further comprising a common pump outlet for merging the liquids emanating from the chamber outlet check valves and a common pump inlet for supplying the fluid to the chamber inlet valves.

8. The double acting pump of claim 7 wherein the pair of movable members comprise a pair of diaphragms which cease to move in unison when the resiliently yieldable means yields, the diaphragms being fixed relative to their respective pumping chambers about their outer peripheries and centrally coupled to the resiliently yieldable means.

9. The double acting pump of claim 8 wherein the resiliently yieldable means comprises a pair of coil springs; the double acting pump further comprising a rotary speed reducing gear train coupling the drive means to the means for converting.

10. In a fluid pump having a rotary power source, and a rotary to reciprocating motion converter, the improvement for limiting fluid pressure without utilizing a pressure relief bypass comprising, a pair of opposed diaphragms defining at their outwardly facing surfaces a pair of pumping chambers, the diaphragms normally driven in unison by the rotary to reciprocating motion converter to alternately force fluid from one and then the other of the chambers, and a resiliently yieldable coupling between the rotary to reciprocating motion converter and the diaphragms for limiting the fluid pressure within the pumping chambers to predetermined maximum pressures, the diaphragms being fixed relative to their respective pumping chambers about their outer peripheries and centrally coupled to the resiliently yieldable coupling, the diaphragms ceasing to move in unison when the resiliently yieldable coupling yields.

11. The improvement of claim 10 wherein the rotary to reciprocating motion converter comprises a cam and cam follower coupling the resiliently yieldable coupling to the rotary power source.

12. The improvement of claim 10 wherein the resiliently yieldable coupling comprises a pair of coil springs, the double acting pump further comprising a rotary speed reducing gear train coupling the rotary power source to the rotary to reciprocating motion converter.

13. The improvement of claim 10 especially adapted to pumping variable viscosity fluids, wherein each chamber has a one-way inlet check valve for allowing a liquid to enter the corresponding chamber while substantially preventing any passage of liquid from the chamber, and each chamber has a one-way outlet check valve for allowing the liquid to exit the corresponding chamber while substantially preventing any passage of liquid into the chamber.

14. The improvement of claim 13 further comprising a common pump outlet for merging the liquids emanating from the chamber outlet check valves and a common pump inlet for supplying the fluid to the chamber inlet valves.

15. A high viscosity fluid pump having a rotary power source, a rotary to reciprocating motion converter, a pair of opposed diaphragms defining at their outwardly facing surfaces a pair of pumping chambers with the diaphragms normally being driven in unison by the rotary to reciprocating motion converter to alternately force fluid from one and then the other of the chambers, and a spring-loaded lost motion coupling between the rotary to reciprocating motion converter and the diaphragms for limiting the fluid pressure within the pumping chambers to predetermined maximum pressures whereby the spring-loaded lost motion coupling absorbs energy while limiting the pressure in a chamber and releases that stored energy to help power the pump while expelling fluid from the other chamber and the diaphragms may cease to move in unison when the spring-loaded lost motion coupling begins to absorb energy.

16. The combination of claim 15 wherein the rotary to reciprocating motion converter comprises a cam and cam follower coupling the spring-loaded lost motion coupling to the rotary power source.

17. The combination of claim 15 wherein the rotary to reciprocating motion converter includes a lubricant and each diaphragm includes heat transfer means of high thermal conductivity for transferring heat from the rotary power source by way of the lubricant to fluid within the corresponding pumping chamber.

18. A high viscosity fluid pump having a source of reciprocating motion, a pair of opposed diaphragms defining at their outwardly facing surfaces a pair of pumping chambers with the diaphragms normally being driven in unison by the source of reciprocating motion to alternately force fluid from one and then the other of the chambers, and a spring-loaded lost motion coupling between the source of reciprocating motion and the diaphragms for limiting the fluid pressure within the pumping chambers to predetermined maximum pressures, the spring-loaded lost motion coupling absorbing energy while limiting the pressure in a chamber and releases that stored energy to help power the pump while expelling fluid from the other chamber.

* * * * *